US005112530A

United States Patent [19]

Baur et al.

[11] Patent Number: 5,112,530

[45] Date of Patent: May 12, 1992

[54] USE OF 2-HYDROXY-3-AMINOPROPIONIC ACID DERIVATIVES AS COMPLEXING AGENTS, BLEACH STABILIZERS AND BUILDERS IN DETERGENT COMPOSITIONS

[75] Inventors: Richard Baur, Mutterstadt; Charalampos Gousetis; Stefan Birnbach, both of Ludwigshafen; Michael Kneip, Frankenthal; Alfred Oftring, Bad Durkheim, all of Fed. Rep. of Germany

[73] Assignee: BASF Aktiengesellschaft, Ludwigshafen, Fed. Rep. of Germany

[21] Appl. No.: 552,098

[22] Filed: Jul. 13, 1990

[30] Foreign Application Priority Data

Aug. 3, 1989 [DE] Fed. Rep. of Germany ..... 3925727

[51] Int. Cl.[5] ..... C11D 3/30; C11D 7/32; C11D 9/30; C07C 229/24

[52] U.S. Cl. ..... 252/548; 252/546; 252/94; 252/102; 252/DIG. 11; 562/568; 562/567; 562/564; 562/571

[58] Field of Search ..... 252/546, 548, DIG. 11, 252/94, 102; 562/568, 567, 564, 571; 260/404, 404.5

[56] References Cited

U.S. PATENT DOCUMENTS

| | | | |
|---|---|---|---|
| 2,781,374 | 2/1957 | Mannheimer | 260/401 |
| 2,781,375 | 2/1957 | Mannheimer | 260/401 |
| 2,781,379 | 2/1957 | Mannheimer | 260/401 |
| 2,781,388 | 2/1957 | Mannheimer | 252/548 |
| 2,781,389 | 2/1957 | Mannheimer | 252/546 |
| 2,781,391 | 2/1957 | Mannheimer | 252/546 |
| 3,840,480 | 10/1974 | Barrat | 252/545 |

FOREIGN PATENT DOCUMENTS

| | | |
|---|---|---|
| 0287846 | 10/1988 | European Pat. Off. . |
| 0356947 | 8/1989 | European Pat. Off. . |
| 3830536 | 9/1988 | Fed. Rep. of Germany . |
| 2124807 | 6/1976 | France . |

*Primary Examiner*—Paul Lieberman
*Assistant Examiner*—Erin M. Higgins
*Attorney, Agent, or Firm*—Oblon, Spivak, McClelland, Maier & Neustadt

[57] ABSTRACT

2-Hydroxy-3-aminopropionic acid derivatives of the general formula I

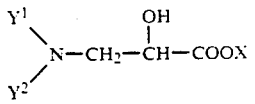

I where X is hydrogen, an alkali metal or ammonium which may be substituted by $C_1$-$C_4$-alkyl or $C_1$-$C_4$-hydroxyalkyl, and $Y^1$ and $Y^2$ have the following meanings:

A) ω-substituted alkyl of the general formula $$-(CH_2)_m-R^1$$

where $R^1$ is hydrogen, hydroxyl or —COOX, —NH—CH(COOX)—$CH_2$—COOX or —$NY^1Y^2$ and m is from 1 to 20, although m is not 1 when $Y^1$ and $Y^2$ are identical and $R^1$ is —COOX, B) a polyether group of the general formula $$-(CH_2CH_2O)_m-R^2$$

where $R^2$ is hydrogen or $C_1$-$C_4$-alkyl,

C) a β-hydroxyl-substituted group of the general formula

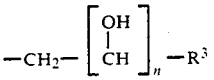

where $R^3$ is —COOX, —$CH_2OH$ or —$CH_2$—$NY^1Y^2$ and n is from 1 to 5,

D) an α-carboxyl-substituted group of the general formula

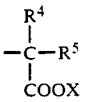

where $R^4$ is hydrogen, methyl or hydroxymethyl and $R^5$ is hydroxymethyl or —CH(OH)—COOX or —$(CH_2)_p$—COOX, where p is 1 or 2, E) pyranosyl or furanosyl of the general formula

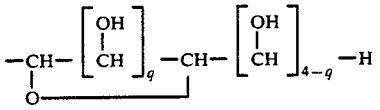

where q is 3 or 2, or

F) a polymeric residue of a polyvinylamine or polyethyleneimine, are useful as complexing agents, bleach stabilizers and builders in detergent compositions.

7 Claims, No Drawings

USE OF 2-HYDROXY-3-AMINOPROPIONIC ACID DERIVATIVES AS COMPLEXING AGENTS, BLEACH STABILIZERS AND BUILDERS IN DETERGENT COMPOSITIONS

The present invention relates to the use of 2-hydroxy-3-aminopropionic acid derivatives of the general formula I

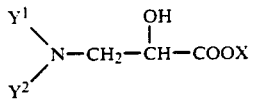

I where X is hydrogen, an alkali metal or ammonium which may be substituted by $C_1$–$C_4$-alkyl or $C_1$–$C_4$-hydroxyalkyl, and $Y^1$ and $Y^2$ have the following meanings:

A) ω-substituted alkyl of the general formula $$-(CH_2)_m-R^1$$

where $R^1$ is hydrogen, hydroxyl or —COOX, —NH—CH(COOX)—$CH_2$—COOX or —$NY^1Y^2$ and m is from 1 to 20, although m is not 1 when $Y^1$ and $Y^2$ are identical and $R^1$ is —COOX, B) a polyether group of the general formula.

$$-(CH_2CH_2O)_m-R^2$$

where $R^2$ is hydrogen or $C_1$–$C_4$-alkyl,

C) a β-hydroxyl-substituted group of the general formula

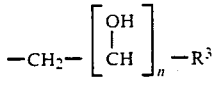

where $R^3$ is —COOX, —$CH_2OH$ or —$CH_2$—$NY^1Y^2$ and n is from 1 to 5,

D) an α-carboxyl-substituted group of the general formula

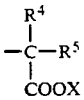

where $R^4$ is hydrogen, methyl or hydroxymethyl and $R^5$ is hydroxymethyl or —CH(OH)—COOX or —$(CH_2)_p$—COOX, where p is 1 or 2, E) pyranosyl or furanosyl of the general formula

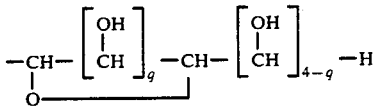

where q is 3 or 2, or

F) a polymeric residue of a polyvinylamine or polyethyleneimine as complexing agents, bleach stabilizers and builders in detergent compositions. The present invention also relates to detergent compositions which contain compounds I.

Some of compounds I are novel substances. Therefore, the present invention also relates to these novel compounds, to a process for preparing same, to the use thereof as complexing agents for heavy metal and alkaline earth metal ions. and to the complexing compositions containing them.

DE-A-2 103 453 (1) concerns α-hydroxy-β-aminocarboxylic acids of the general formula IV

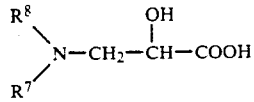

IV where $R^7$ and $R^8$ are each an aliphatic, cycloaliphatic or araliphatic radical, except methyl, and may also be, inter alia, hydrogen, an alkylol group or —$CH_2$—CH(OH)—COOH. Furthermore, one of $R^7$ and $R^8$ may carry a second substituted amino group —$NR^7R^8$. Compounds IV serve to sequester metal ions, in particular heavy metal cations, by complex formation in aqueous solution.

DE-A-3 712 330 (2) describes 2-hydroxy-3-aminopropionic-N,N-diacetic acid and derivatives thereof of the general formula V

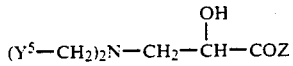

V where $Y^5$ may be inter alia —COOX and Z is —OX, —$OR^6$ or —$N(R^2)_2$, $R^6$ being $C_1$–$C_4$-alkyl. Compounds V are recommended as complexing agents for heavy metal and alkaline earth metal ions and as bleach stabilizers and builders in detergent compositions. However, their bleach-stabilizing action leaves something to be desired.

It is an object of the present invention to provide complexing agents which make more effective bleach stabilizers.

We have found that this object is achieved by using the 2-hydroxy-3-aminopropionic acid derivatives I defined at the beginning as complexing agents, bleach stabilizers and builders in detergent compositions.

Compounds I can appear as free carboxylic acids (X=H) or in a partial salt form (if more than one carboxyl group is present) or a complete salt form. If the latter, X is an alkali metal ion such a lithium or in particular sodium or potassium or an ammonium ion which may be partially or completely substituted by $C_1$–$C_4$-alkyl or $C_1$–$C_4$-hydroxyalkyl. Of particular interest here are the salts of tertiary amines. Preferred tertiary amines are trimethylamine, triethylamine, tri-n-propylamine, triisopropylamine, tri-n-butylamine, triisobutylamine and also trialkanolamines such as triethanolamine and triisopropanolamine.

Groups $Y^1$ and $Y^2$ have the following meanings:

A) ω-substituted alkyl of the general formula $$-(CH_2)_m-R^1$$

where $R^1$ is in particular hydrogen, hydroxyl or —COOX, but may also be —NH—CH(COOX)—$CH_2$—COOX or —$NY^1Y^2$ and m is from 1 to 20, preferably from 1 to 6, although m is not 1 when $Y^1$ and $Y^2$ are identical and $R^1$ is —COOX; an example of —$NY^1Y^2$ is

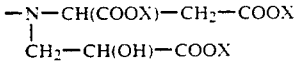

B) a polyether group of the general formula $$-(CH_2CH_2O)_m-R^2$$

where $R^2$ is hydrogen or $C_1$–$C_4$-alkyl, for example methyl, ethyl, n-propyl, isopropyl or n-butyl;

C) a β-hydroxyl-substituted group of the general formula

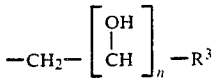

where $R^3$ is in particular —COOX or $—CH_2OH$ but may also be $—CH_2—NY^1Y^2$, and n is from 1 to 5; preferred values of n are 1 and 4;

D) an α-carboxyl-substituted group of the general formula

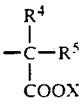

where $R^4$ is hydrogen, methyl or hydroxymethyl and $R^5$ is hydroxymethyl or —CH(OH)—COOX or $—(CH_2)_p—COOX$, where p is 1 or 2;

E) pyranosyl or furanosyl of the general formula

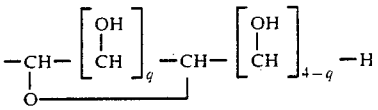

where q is 3 or 2; preferred groups are glucopyranosyl (q=3) and glucofuranosyl (q=2); or F) a polymeric residue of a polyvinylamine or polyethyleneimine.

Particularly preferred $Y^1$ and $Y^2$ are each A, C or

The present invention further provides 2-hydroxy-3-aminopropionic acid derivatives of the general formula Ia

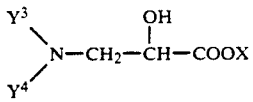

Ia where X is hydrogen, an alkali metal or ammonium which may be substituted by $C_1$–$C_4$-alkyl or $C_1$–$C_4$-hydroxyalkyl and where $Y^3$ and $Y^4$ are each defined as follows:

A) ω-substituted alkyl of the general formula $$-(CH_2)_m-R^9$$

where $R^9$ is —COOX, —NH—CH(COOX)—$CH_2$—COOX or $—NY^3Y^4$ or, if m is 1, hydrogen and m is from 1 to 20, although m is not 1 if $Y^3$ and $Y^4$ are identical and $R^9$ is —COOX, B) a polyether group of the general formula $$-(CH_2CH_2O)_m-R^2$$

where $R^2$ is hydrogen or $C_1$–$C_4$-alkyl.

C) a β-hydroxyl-substituted group of the general formula

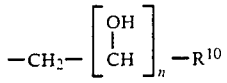

where $R^{10}$ is —COOX, $—CH_2OH$ or $—CH_2—NY^3Y^4$ and n is from 1 to 5, although n is not 1 if $Y^3$ and $Y^4$ are identical and $R^{10}$ is —COOX, D) an α-carboxyl-substituted group of the general formula

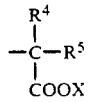

where $R^4$ is hydrogen, methyl or hydroxymethyl and $R^5$ is hydroxymethyl or —CH(OH)—COOX or $—(CH_2)_p—COOX$, where p is 1 or 2, E) pyranosyl or furanosyl of the general formula

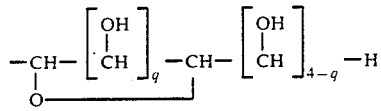

where q is 3 or 2, or

F) a polymeric residue of a polyvinylamine or polyethyleneimine.

The compounds Ia, which form a subgroup of the compounds I are novel.

The compounds I and in particular compounds Ia are advantageously prepared by reacting a glycidic acid derivative of the general formula II

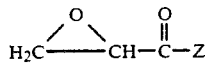

II where Z is —OX, $—OR^6$ or $—N(R^2)_2$, where $R^6$ is $C_1$–$C_4$-alkyl and each $R^2$ may be identical to or different from the other, with ammonia or an amine of the general formula IIIa or IIIb

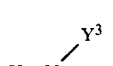

IIIa

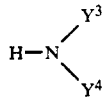

IIIb and subsequent hydrolysis of any carboxamide or carboxylic ester groups still present.

The glycidic acid derivative II can be for example glycidic acid, if desired in the form of its sodium, potassium or ammonium salt, glycidamide, N-methylglycidamide, N,N-dimethylglycidamide, methyl glycidate or ethyl glycidate. The best results are obtained with glycidamide.

Examples of primary amines IIIa are glycine, asparagic acid, serine, 2-methylserine, 2-(hydroxymethyl)serine, 1-amino-2-hydroxysuccinic acid, ethanolamine, ethanolamine methyl ether, ethanolamine 2-hydroxyethyl ether, sorbitylamine, glycopyranosylamine, glucofuranosylamine, polyvinylamine, 1,2-ethylenediamine, 1,3-propylenediamine, 1,4-butylenediamine and 2-hydroxypropane-1,3-diamine.

Examples of secondary amines IIIb are sarcosine, iminodisuccinic acid, iminodi(2-hydroxysuccinic acid), ethanolaminoacetic acid, diethanolamine, disorbitylamine and polyethyleneimine.

Of the amines IIIa and IIIb mentioned, glycine, asparagic acid, ethanolamine, ethanolaminoacetic acid, diethanolamine and sarcosine are preferred.

It is also possible to use polyamines having primary and secondary amino functions such as diethylenetriamine and triethylenetetramine.

The carboxyl groups present in some of the above-mentioned amines may also be in the form of the alkali metal or substituted or unsubstituted ammonium salts.

The reaction of the glycidic ester derivative II with ammonia or an amine IIIa or IIIb is in general carried out in water, an organic solvent such as methanol, ethanol, n-propanol, isopropanol, tert-butanol, dioxane or tetrahydrofuran or in mixtures of these solvents at from 10° to 100° C., preferably from 40° to 80° C., and at a pH of from 4 to 10, preferably from 6 to 9.

The molar ratio of II to ammonia or amine is customarily within the range of from 2.8:1 to 3.7:1, in particular from 3.0:1 to 3.3:1, in the case of ammonia, from 1.8:1 to 2.7:1, in particular from 2.0:1 to 2.3:1, in the case of primary amines IIIa and from 0.8:1 to 1.5:1, in particular from 1.0:1 to 1.2:1, in the case of secondary amines IIIb; the stated ratios are each based on one amino group in the compound IIIa or IIIb.

The reaction is followed by a hydrolysis of any carboxamide or carboxylic ester group still present into carboxyl groups, which is carried out in a conventional manner in aqueous medium in the presence of bases such as sodium hydroxide solution or potassium hydroxide solution or of acids such as sulfuric or hydrochloric acid, in general at from 20° to 110° C., in particular at from 40° to 100° C.

Depending on the reaction conditions, the compounds I and Ia are obtained as free carboxylic acids or in the form of salts, customarily as alkali metal salts. From the free acids it is then possible, by neutralization with appropriate bases for example amine bases, to prepare the desired salts I and Ia without difficulties.

The compounds I and Ia are easy to isolate from their solutions in the pure form. Suitable techniques for this purpose are in particular spray or freeze drying, crystallization and precipitation. Frequently, the solutions can also be used directly for the purposes of the present invention.

The compounds I are highly suitable for complexing heavy metal or alkaline earth metal ions such as iron, copper, manganese, zinc, calcium or magnesium or mixtures thereof. Owing to this capability they have a multiplicity of technical applications. Since the compounds I are biodegradable substances, they can be used advantageously wherever their use results in major amounts of waste water which must first be treated before being passed into the surface water.

Possible uses and applications are for example household detergents and cleaners, industrial cleaners, electroplating, water treatment, polymerizations, the photographic industry, the textile industry and paper industry and also various uses in pharmaceuticals, cosmetics, food and plant nutrition.

They also have an advantageous bleach stabilizing effect, for example for sodium perborates such as $NaBO_2.H_2O_2.3H_2O$, peroxycarbonates, peroxyphosphonates, citrate perhydrates, urea- and melamine-$H_2O_2$ adducts, caroates, perbenzoates, alkanedipercarboxylic acids, peroxyphthalates and alkali metal hypochlorites in detergent compositions and in the hydrogen peroxide bleaching of textiles, cellulose or raw paper stock. Traces of heavy metals such as iron, copper and manganese occur in the washing powder itself, in water and in the textile material and catalyze the decomposition of the percompound or of the hydrogen peroxide formed therefrom. The complexing agents I bind these metal ions and prevent the undesirable decomposition of the bleaching system during storage and in the wash liquor. This increases the efficiency of the bleach system and minimizes fiber damage.

In liquid detergent compositions the compounds I can be used as preservatives, advantageously in an amount of from 0.05 to 1% by weight, based on the total weight of the detergent formulation.

In soaps the compounds I prevent for example metal-catalyzed oxidative decompositions.

They also make highly effective builders in detergent compositions, preventing precipitation and incrustation on the fabric.

They can be used with advantage in any industrial process where precipitates of calcium, magnesium and heavy metal salts are undesirable, for example for preventing fouling and scaling in kettles, pipelines, spray nozzles or generally on smooth surfaces.

They can be used for stabilizing phosphates in alkaline degreasing baths and for preventing the precipitation of lime soaps and thereby prevent the staining of nonferrous surfaces and prolong the lives of alkaline cleaning baths.

They can be used as complexing agents in alkaline derusting and deburring baths and also in electroplating baths in place of cyanides.

Cooling water treatment with compounds I prevents scaling and redissolves existing scale. A particular advantage is the possibility of use in an alkaline medium and hence the elimination of corrosion problems.

In the polymerization of rubber they can be used for preparing the redox catalysts used therein. They additionally prevent the precipitation of iron hydroxide in the alkaline polymerization medium.

In the photographic industry the complexing agents I can be used in developer or fixing baths prepared with hard water in order to prevent the precipitation of sparingly soluble calcium and magnesium salts. Such precipitates lead to a frosting effect on films and images and to deposits in the tanks, which are thus advantageously avoidable. They can advantageously be used as iron(III) chelate solutions in bleaching and bleaching/fixing baths and thus replace the ecologically unsafe hexacyanoferrate solutions.

In the textile industry they can be used for removing heavy metal traces during the production or dyeing of natural and synthetic fibers. This eliminates many problems, for example spots and stripes on the textile material, loss of luster, poor wettability, unlevel dyeings and off-shades.

In the paper industry they can be used for eliminating heavy metal ions, in particular iron ions. The incorporation of iron in paper leads to hot spots which initiate the oxidative catalytic destruction of the cellulose. Furthermore, heavy metal ions catalyze the decomposition of $H_2O_2$ which is used as a paper bleach.

Further examples of applications are in pharmaceuticals, cosmetics and food in order to prevent the metal-catalyzed oxidation of olefinic double bonds and hence the rancidification of the products.

In plant nutrition, heavy metal deficits can be remedied using copper, iron, manganese and zinc complexes with I. These heavy metals are added in the form of chelates in order to prevent their precipitation as biologically inactive insoluble salts.

Further applications for the compounds I are flue gas scrubbing, to be precise the simultaneous removal of $NO_x$ and $SO_2$ from flue gases, the Wellman-Lord desulfurization, the oxidation of $H_2S$, the field of metal extraction and applications as catalysts for organic syntheses, e.g. air oxidation of paraffins and hydroformylation of olefins to give alcohols.

The compounds I and their excellent complexing properties are particularly qualified among the fields of application mentioned for use as bleach stabilizers and as builders in detergent compositions.

The present invention accordingly also provides compositions for complexing heavy metal or alkaline earth metal ions or mixtures thereof, containing according to purpose the compounds Ia in an amount of from 0.01 to 99% by weight, based on the total amount of the formulations.

The present invention further provides detergent compositions which contain from 0.01 to 20% by weight, preferably from 0.05 to 10% by weight, based on the total amount of the formulation, of one or more compounds I. If used preferentially as a builder the particularly preferred amount is from 1 to 10% by weight, while if used preferentially as a bleach stabilizer, for example for perborates, an amount of from 0.05 to 1% by weight is particularly preferred. If used especially as a complexing agent in a detergent composition, an amount of from 0.1 to 2% by weight is preferred.

The compounds I can also be used as complexing agents, builders and bleach stabilizers in detergent compositions together with other, prior art compounds, which may distinctly improve in certain circumstances the general properties in respect of sequestration, incrustation inhibition, grayness inhibition, primary detergency and bleaching action.

Detergent compositions which contain compounds I generally contain as additional ingredients, based on the total weight, from 6 to 25% by weight of surfactants, from 15 to 50% by weight of builders and possibly cobuilders and from 5 to 30% by weight of assistants such as enzymes, foam regulators, corrosion inhibitors, fluorescent whitening agents, scents, dyes or formulation aids such as sodium sulfate in the usual amounts.

The 2-hydroxy-3-aminopropionic acid derivatives I are excellent complexing agents. Used as builders in detergent compositions for improving the white wash effect and for preventing deposits on the fabric, the compounds I can be compared for example with ethylenediaminetetraacetic acid or 2-hydroxy-3-aminopropionic-N,N-diacetic acid. However, they are distinctly superior to said prior art compounds as regards bleach stabilization.

PREPARATION EXAMPLES

Example 1

Nitrilodi(2-hydroxy-3-aminopropionic acid)monoacetic acid, trisodium salt

To a solution of 37.5 g (0.5 mol) of glycine in 150 g of water which had been adjusted to pH 8 with 0.6 g of 50% strength by weight sodium hydroxide solution, 478.5 g of a 20% strength by weight aqueous glycidamide solution (corresponding to 1.1 mol of glycidamide) were added dropwise at 50° C. in the course of 1 hour. During the dropwise addition the pH of the reaction solution was maintained at from 8 to 8.5 by the addition of a further 88 g of 50% strength by weight sodium hydroxide solution. This was followed by stirring at 50° C. for 30 minutes and then at 80° C. for 3 hours. Following addition of a further 100 g of 50% strength by weight sodium hydroxide solution, the solution was then stirred at 80° C. for 2 hours and thereafter at 100° C. for 1.5 hours, during which the ammonia formed evolved as a gas.

After cooling, the solution was admixed with three times the volume of methanol. The precipitate formed was filtered off and recrystallized from a water-methanol mixture. The title compound was obtained in a yield of 66% in the form of a colorless crystalline powder with a melting point above 300° C.

Example 2

N-(2-Hydroxyethyl)-2-hydroxy-3-aminopropionic-N-monoacetic acid, disodium salt 282 g (1.0 mol) of sodium ethanolaminoacetate were reacted with an equimolar amount of glycidamide as described in Example 1, except that sodium hydroxide solution was only added until after the reaction had taken place, for the purpose of hydrolyzing the carboxamide group.

The resulting solution was spray dried and the resulting light brown powder was recrystallized from a water-methanol mixture. The title compound was obtained in a yield of 74% in the form of a colorless crystalline powder having a melting point >280° C.

Example 3

Nitrilodi(2-hydroxy-3-aminopropionic acid)monosuccinic acid, tetrasodium salt

This compound was prepared in a yield of 55% as described in Example 1 by reacting asparagic acid with glycidamide in a molar ratio of 1:2.2. Following recrystallization it had a melting point of 125° C. (with decomposition).

Example 4

Nitrilodi(2-hydroxy-3-aminopropionic acid)mono(2-carboxy-2-aminoethanol), trisodium salt This compound was prepared in a yield of 57% as described in Example 1 by reacting serine with glycidamide in a molar ratio of 1:2.2. Following recrystallization it had a melting point of 120° C. (with decomposition).

Example 5

Nitrilodi(2-hydroxy-3-aminopropionic acid)monoethanolamine, disodium salt

This compound was prepared as described in Example 2 by reacting ethanolamine with glycidamide. It is known from reference (1).

Example 6

Nitrilotri(2-hydroxy-3-aminopropionic acid), trisodium salt

This compound was prepared as described in Example 2 by reacting ammonia with glycidamide. It is known from reference (1).

Example 7

N-Methyl-2-hydroxy-3-aminopropionic-N-monoacetic acid, disodium salt

This compound was prepared in a yield of 94% as described in Example 1 by reacting equimolar amounts of sarcosine with glycidamide. Following recrystallization it had a melting point of >310° C.

Application properties

Determination of sodium perborate stabilization in wash liquors

The hydrogen peroxide responsible for the bleaching effect of sodium perborate-containing detergent formulations is catalytically decomposed by heavy metal ions (Fe, Cu, Mn) not only in the wash liquor but even in the course of dry storage. This process of decomposition can be prevented or at least retarded by complexing the heavy metal ions. The peroxide-stabilizing effect of complexing agents is determined via the residual peroxide content on leaving a heavy metal-containing wash liquor at elevated temperature for a certain period.

The hydrogen peroxide content was determined by titration with potassium permanganate in an acid solution immediately on preparation and after leaving the wash liquor at 60° C. or 80° C. for 1 or 2 hours. The result is reported in the table below as the percentage of $H_2O_2$ still present after this period.

The test for perborate stabilization was carried out with two detergent formulations (1) and (2); the following percentages are each by weight:

(1) Composition of a high-phosphate formulation:

19.3% of sodium $C_{12}$-alkylbenzenesulfonate (50% strength aqueous solution)
15.4% of sodium perborate tetrahydrate
30.8% of sodium triphosphate
2.6% of copolymer of maleic acid and acrylic acid (weight ratio 50:50, average molecular weight 50,000)
31.0% of anhydrous sodium sulfate
0.9% of complexing agent I or comparative substance (2) Composition of a low-phosphate formulation:

15% of sodium $C_{12}$-alkylbenzenesulfonate (50% strength aqueous solution)
5% of adduct of 11 mol of ethylene oxide with 1 mol of tallow fat alcohol
20% of sodium perborate tetrahydrate
6% of sodium metasilicate.$5H_2O$
1.25% of magnesium silicate
20% of sodium triphosphate
31.75% of anhydrous sodium sulfate
1% of complexing agent I or comparative substance The test was carried out by heating a solution of 6.5 g/l of formulation (1) in water of 25° German hardness to 80° C. and admixing it for test purposes with 2.5 ppm of a mixture of the ions $Fe^{3+}$, $Cu^{2+}$ and $Mn^{2+}$ in a ratio of 8:1:1, used in the form of their sulfates. Titration with $KMnO_4$ in acid solution was used to determine the $H_2O_2$ content before the addition of the heavy metals and after leaving the wash liquor at 80° C. for 2 hours.

Similarly, a solution of 8 g/l of formulation (2) in water of 25° German hardness was heated to 60° C. and treated as described above. The residual $H_2O_2$ content was determined after leaving the wash liquor at 60° C. for 1 hour.

The table below shows the results of the tests, comparing the 2-hydroxy-3-aminopropionic acid derivatives I in their sodium salt form from Examples 1 to 6 with the tetrasodium salt of ethylenediaminetetraacetic acid (EDTA-$Na_4$) and with the trisodium salt of 2-hydroxy-3-aminopropionic-N,N-diacetic acid (ISDA-$Na_3$) as per reference (2). The values illustrate the superiority of compounds I.

TABLE

| Bleach stabilizer | Sodium perborate stabilization [residual % of $H_2O_2$] Formulation (1) | Formulation (2) |
|---|---|---|
| Example 1 | 60.6 | 90.0 |
| Example 2 | 36.5 | 89.0 |
| Example 3 | 51.8 | 79.4 |
| Example 4 | 52.2 | 84.2 |
| Example 5 | 25.5 | 57.4 |
| Example 6 | 51.8 | 80.7 |
| For comparison: | | |
| EDTA-$Na_4$ | 20.0 | 34.0 |
| ISDA-$Na_3$ | 43.4 | 82.0 |
| None | 20.0 | 28.0 |

We claim:

1. A method of washing or cleaning using for this purpose a 2-hydroxy-3-aminopropionic acid derivative of the general formula Ia

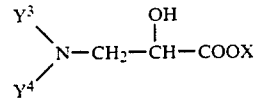

Ia where X is hydrogen, an alkali metal or ammonium which may be substituted by $C_1$–$C_4$-alkyl or $C_1$–$C_4$-hydroxyalkyl, and $Y^3$ and $Y^4$ have the following meanings:

A) a β-hydroxyl-substituted group of the general formula

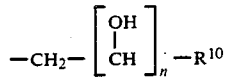

where $R^{10}$ is —COOX, —$CH_2OH$ or —$CH_2$—$NY^3Y^4$ and n is from 1 to 5, although n is not 1 if $Y^3$ and $Y^4$ are identical and $R^{10}$ is —COOX; or an α-carboxyl-substituted group of the general formula

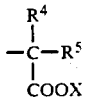

where $R^4$ is hydrogen, methyl or hydroxymethyl and $R^5$ is hydroxymethyl or —CH(OH)—COOX or —$(CH_2)_p$—COOX, where p is 1 or 2; or $Y^3$ is —$CH_2$—$CH_2$—(OH)—COOX and $Y^4$ is —$CH_2$—COOX.

2. A method of washing or cleaning as claimed in claim 1, wherein in the 2-hydroxy-3-aminopropionic acid derivative Ia used for this purpose $Y^3$ and $Y^4$ are each defined as follows:

A) a β-hydroxyl-substituted group of the general formula

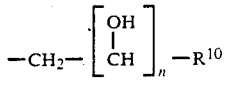

where $R^{10}$ is —COOX or —$CH_2OH$ and n is from 1 to 5, although n is not 1 if $Y^3$ and $Y^4$ are identical and $R^{10}$ is —COOX, or B) an α-carboxyl-substituted group of the general formula

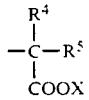

where $R^4$ is hydrogen, methyl or hydroxymethyl and $R^5$ is hydroxymethyl or —CH(OH)—COOX or —$(CH_2)_p$—COOX, where p is 1 or 2, or $Y^3$ is —$CH_2$—CH(OH)—COOX and $Y^4$ is —$CH_2$—COOX.

3. A 2-hydroxy-3-aminopropionic acid derivative of the general formula Ia

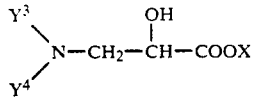

Ia where X is hydrogen, an alkali metal or ammonium which may be substituted by $C_1$–$C_4$-alkyl or $C_1$–$C_4$-hydroxyalkyl and where $Y^3$ and $Y^4$ are each defined as follows:

A) a β-hydroxyl-substituted group of the general formula

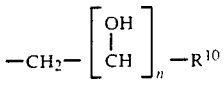

where $R^{10}$ is —COOX, —$CH_2OH$ or —$CH_2$—$NY^3Y^4$ and n is from 1 to 5, although n is not 1 if $Y^3$ and $Y^4$ are identical and $R^{10}$ is —COOX, or B) an α-carboxyl-substituted group of the general formula

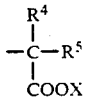

where $R^4$ is hydrogen, methyl or hydroxymethyl and $R^5$ is hydroxymethyl or —CH(OH)—COOX or —$(CH_2)_p$—COOX, where p is 1 or 2, or $Y^3$ is —$CH_2$—CH(OH)—COOX and $Y^4$ is —$CH_2$—COOX.

4. A process for preparing a 2-hydroxy-3-aminopropionic acid derivative Ia as claimed in claim 3, which comprises reacting a glycidic acid derivative of the general formula II

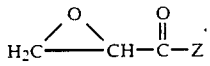

II where Z is —OX, —$OR^6$ or —$N(R^2)_2$, where $R^6$ is $C_1$–$C_4$-alkyl and each $R^2$ may be identical to or different from the other, with ammonia or an amine of the general formula IIIa or IIIb

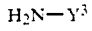

IIIa

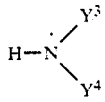

IIIb and then hydrolyzing any carboxamide or carboxylic ester groups still present.

5. A method for complexing a heavy metal or alkaline earth metal ion, which comprises contacting said heavy metal or alkaline earth metal ion with a 2-hydroxy-3-aminopropionic acid derivative Ia as claimed in claim 3.

6. In a composition for complexing a heavy metal or alkaline earth metal ion, the improvement comprising 0.01 to 99% by weight, based on the total amount of the composition, of one or more compounds of the general formula Ia as claimed in claim 3.

7. In a detergent composition, the improvement comprising 0.01 to 20% by weight, based on the total amount of the composition, of one or more compounds of the general formula Ia as claimed in claim 3.

* * * * *